US008508445B2

(12) United States Patent
Yamashita et al.

(10) Patent No.: US 8,508,445 B2
(45) Date of Patent: Aug. 13, 2013

(54) DISPLAY DEVICE AND DISPLAY DRIVE METHOD

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 634 days.

(21) Appl. No.: 12/461,151

(22) Filed: Aug. 3, 2009

(65) Prior Publication Data

US 2010/0045654 A1 Feb. 25, 2010

(30) Foreign Application Priority Data

Aug. 19, 2008 (JP) ..... 2008-210508

(51) Int. Cl.
*G09G 3/30* (2006.01)
*G09G 3/10* (2006.01)

(52) U.S. Cl.
USPC ..... 345/78; 315/169.3

(58) Field of Classification Search
USPC ..... 345/76–78, 80, 82, 83; 315/169.3
See application file for complete search history.

(56) References Cited

U.S. PATENT DOCUMENTS

| | | | | |
|---|---|---|---|---|
| 7,102,202 | B2 | 9/2006 | Kobayashi et al. | |
| 7,876,294 | B2 * | 1/2011 | Sasaki et al. | 345/77 |
| 2004/0046164 | A1 * | 3/2004 | Kobayashi et al. | 257/13 |
| 2005/0206590 | A1 | 9/2005 | Sasaki et al. | |
| 2006/0267884 | A1 * | 11/2006 | Takahashi et al. | 345/76 |
| 2008/0030436 | A1 * | 2/2008 | Iida et al. | 345/77 |
| 2009/0251493 | A1 * | 10/2009 | Uchino et al. | 345/690 |

FOREIGN PATENT DOCUMENTS

| | | |
|---|---|---|
| JP | 2003-271095 | 9/2003 |
| JP | 2005-258326 A | 9/2005 |
| JP | 2006-330223 A | 12/2006 |
| JP | 2007-133282 | 5/2007 |
| JP | 2007-255856 | 10/2007 |
| JP | 2008-033193 A | 2/2008 |

OTHER PUBLICATIONS

Japanese Office Action issued May 6, 2010 for corresponding Japanese Application No. 2008-210508.

* cited by examiner

*Primary Examiner* — Jeff Piziali
(74) *Attorney, Agent, or Firm* — Rader, Fishman & Grauer PLLC

(57) ABSTRACT

A display device includes: a pixel array including pixel circuits arranged in a matrix state, in which each pixel circuit has a light emitting element, a drive transistor, and a storage capacitor storing a threshold voltage of the drive transistor and an inputted signal value; a threshold correction operation means for performing a threshold correction operation plural times, which allows the storage capacitor to store the threshold voltage of the drive transistor before giving the signal value to the storage capacitor; and a cut-off control means for allowing the drive transistor to be cut off in at least one after-correction period and for allowing the drive transistor not to be cut off in at least one after-correction period in plural after-correction periods which are periods after the plural threshold correction operation periods.

16 Claims, 7 Drawing Sheets

DISPLAY DEVICE AND DISPLAY DRIVE METHOD

BACKGROUND OF THE INVENTION

1. Field of the Invention

The invention relates to a display device including a pixel array in which pixel circuits are arranged in a matrix state and a display drive method thereof, and relates to, for example, a display device using an organic electroluminescence element (organic EL element) as a light emitting element.

2. Description of the Related Art

An image display device in which an organic EL element is used in a pixel is developed, for example as shown in JP-2003-255856 and JP-2003-271095 (Patent Documents 2 and 3). Since the organic EL element is a self-luminous element, it has advantages such that visibility of images is higher than, for example, a liquid crystal display, a backlight is not necessary and response speed is high. The luminance level (tone) of each light emitting element can be controlled by a value of current flowing therein (so-called current-control type).

The organic EL display has a passive matrix type and an active matrix type as a drive method in the same manner as the liquid crystal display. The former has problems such that it is difficult to realize a large-sized as well as high-definition display though it has a simple configuration, therefore, the active-matrix type display device is vigorously developed at present. The display device of this type controls electric current flowing in the light emitting element in each pixel circuit by an active element (commonly, a thin film transistor: TFT) provided inside the pixel circuit.

SUMMARY OF THE INVENTION

As the pixel circuit configuration using the organic EL element, improvement of display quality as well as realization of high luminance, high definition and a high frame rate (high frequency) by eliminating luminance unevenness in each pixel and the like are strongly requested.

From the above viewpoint, various configurations are considered. For example, pixel circuit configurations and operations are variously proposed, in which luminance unevenness in each pixel can be eliminated by cancelling variation of a threshold voltage or mobility of a drive transistor in each pixel as in JP-2007-133282 (Patent Document 1).

It is desirable to realize a more suitable threshold cancel operation as the display device using the organic EL element.

According to an embodiment of the invention, there is provided a display device including a pixel array having pixel circuits arranged in a matrix state, in which each pixel circuit has at least a light emitting element, a drive transistor applying electric current to the light emitting element in accordance with a signal value given between a gate and a source by a drive voltage applied between the drain and the source, and a storage capacitor connected between the gate and the source of the drive transistor and storing a threshold voltage of the drive transistor and the inputted signal value. The display device further includes a threshold correction operation means for performing a threshold correction operation plural times, which allows the storage capacitor to store the threshold voltage of the drive transistor before giving the signal value to the storage capacitor and a cut-off control means for allowing the drive transistor to be cut off in at least one after-correction period and for allowing the drive transistor not to be cut off in at least one after-correction period in plural after-correction periods which are periods after the plural threshold correction operation periods.

The threshold correction operation means performs the threshold correction operation by supplying a drive voltage to the drive transistor in a state in which a gate potential of the drive transistor is in a reference value in the threshold correction operation periods. The cut-off control means allows the drive transistor to be cut off by supplying an intermediate voltage which is lower than the drive voltage to the drive transistor as well as allows the drive transistor not to be cut off by maintaining the supply of the drive voltage to the drive transistor in the after-correction periods.

The display device also includes a signal selector supplying potentials as the signal value and the reference value to respective signal lines arranged in columns on the pixel array, a write scanner introducing potentials of the signal lines into the pixel circuits by driving respective write control lines arranged in rows on the pixel array and a drive control scanner applying the drive voltage to the drive transistors in the pixel circuits by using respective power control lines arranged in rows on the pixel array. The threshold correction operation means is realized by an operation of making the gate potential of the drive transistor be the reference value given from the signal line by the write scanner and an operation of supplying the drive voltage to the drive transistor by the drive control scanner. The cut-off control means is realized by an operation of cutting off the drive transistor by supplying the intermediate voltage which is lower than the drive voltage to the drive transistor by the drive control scanner and an operation of not cutting off the drive transistor by maintaining the supply of the drive voltage to the drive transistor.

The cut-off control means allows the drive transistor to be cut off in at least a first after-correction period in plural after-correction periods.

The cut-off control means also allows the drive transistor to be cut off in a first-half after-correction periods and allows the drive transistor not to be cut off in a last-half after-correction periods in plural after-correction periods.

The pixel circuit further includes a sampling transistor in addition to the light emitting element, the drive transistor and the storage capacitor, in which the sampling transistor is connected to the write control line at a gate thereof, connected to the signal line at one of source/drain, and connected to the gate of the drive transistor at the other of source/drain, and in which the drive transistor is connected to the light emitting element at one of source/drain and connected to the power control line at the other of source/drain.

The threshold correction operation means performs the threshold correction operation by supplying the drive voltage to the drive transistor in a state in which a gate potential of the drive transistor is in a reference value given from the signal line in the threshold correction operation periods, and the cut-off control means allows the drive transistor to be cut off by making the gate potential of the drive transistor be a cut-off control potential as well as allows the drive transistor not to be cut off by not making the gate potential of the drive transistor be the cut-off control potential in the after-correction periods.

The display device also includes a signal selector supplying the signal value, the reference value and the cut-off control potential to respective signal lines arranged in columns on the pixel array, a write scanner introducing potentials of the signal lines into the pixel circuits by driving respective write control lines arranged in rows on the pixel array and a drive control scanner applying the drive voltage to the drive transistors in the pixel circuits by using respective power control lines arranged in rows on the pixel array. The threshold correction operation means is realized by a circuit operation of making the gate potential of the drive transistor be the reference value given from the signal line by the write scanner and a circuit operation of supplying the drive voltage to the drive transistor by the drive control scanner. The cut-off control means is realized by an operation of cutting off the drive transistor by supplying the cut-off control potential from the signal line to the gate of the drive transistor by the drive control scanner and an operation of not cutting off the drive transistor by not supplying the cut-off control potential to the drive transistor.

A display drive method according to another embodiment of the invention includes the steps of performing a threshold correction operation plural times, which allows the storage capacitor to store the threshold voltage of the drive transistor before giving the signal value to the storage capacitor and allowing the drive transistor to be cut off in at least one after-correction period and for allowing the drive transistor not to be cut off in at least one after-correction period in plural after-correction periods which are periods after the plural threshold correction operation periods.

As the pixel circuit operation in the organic EL display device is performed in a higher frequency, the threshold correction operation of the drive transistor is performed in a time division manner in some cases. The threshold correction operation is performed in the time division manner, thereby securing time necessary for the threshold correction operation and cancelling variation of the threshold appropriately. However, when the number of divided correction operations is increased, complication of one cycle as the pixel circuit operation is worsened and adverse effects such as power fluctuation may occur. Accordingly, it is desirable to reduce the number of divided operations. For that purpose, a rapid threshold correction operation becomes necessary.

Here, it is possible to prevent the increase of the gate potential and the source potential and to perform more accurate threshold correction by cutting off the drive transistor in periods after the threshold correction operations (after-correction periods) to suppress leak current. On the other hand, it is possible to allow the voltage between the gate and the source of the drive transistor to converge to the threshold voltage earlier by positively using the leak current. That is, the threshold correction operation can be accelerated.

In the embodiments of the invention, both accuracy and quickness in the threshold correction operation are realized by providing a period in which the drive transistor is cut off and a period in which the drive transistor is not cut off in plural after-correction periods.

According to the embodiments of the invention, when performing threshold correction in the time division manner, a period in which drive transistor is cut off and a period in which drive transistor is not cut off are provided as after-correction periods. In an after-correction period (for example, the first after-correction period) among the plural after-correction periods, in which adverse effects due to leak current are concerned, the drive transistor is cut off to secure the accuracy of the threshold correction operation. In an after-correction period in which adverse effects due to leak current are not concerned, the drive transistor is not cut off, and the voltage between the gate and the source of the drive transistor is made to be closer to the threshold voltage earlier by using the potential increase of the source and the gate due to leak current. Accordingly, it is possible to realize both accuracy and quickness in the threshold correction operation. Then, it is possible to reduce the number of divided corrections as well as to reduce power fluctuation and the like in the power control lines.

DESCRIPTION OF THE PREFERRED EMBODIMENTS

Hereinafter, as a display device according to an embodiment of the invention, an example of a display device using the organic EL element will be explained in the following order.

Figure 1:
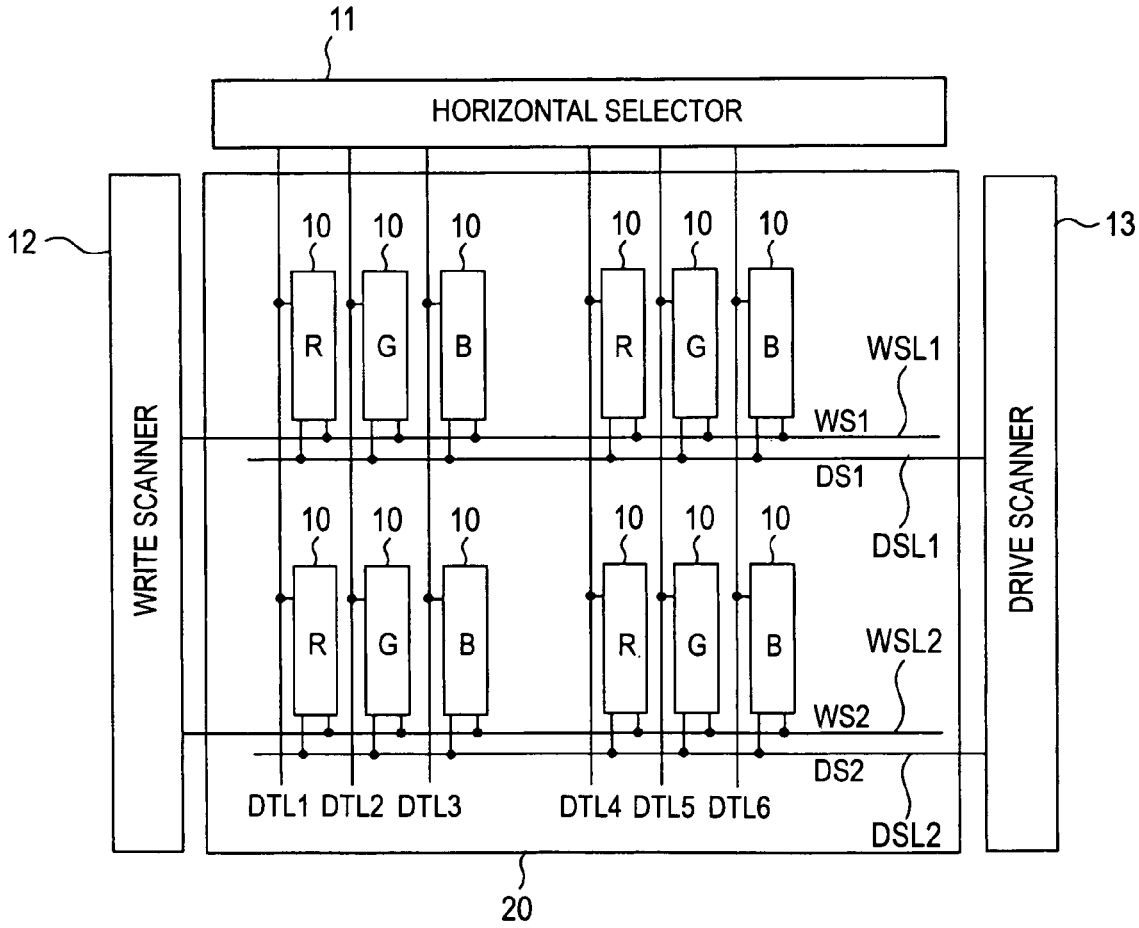
FIG. 1 is an explanatory diagram of a configuration of a display device according to an embodiment of the invention.

1. Configuration of a display device according to an embodiment
2. Pixel circuit operation in a process leading to an embodiment of the invention
3. Pixel circuit operation as a first embodiment of the invention
4. Pixel circuit operation as a second embodiment of the invention 1. Configuration of a Display Device According to an Embodiment FIG. 1 shows the whole configuration of a display device according to an embodiment. The display device includes pixel circuits 10 having a correction function with respect to variation of a threshold voltage and mobility of a drive transistor as described later.

As shown in FIG. 1, the display device of the embodiment includes a pixel array unit 20 in which pixel circuits 10 are arranged in a column direction as well as a row direction in a matrix state. "R", "G" and "B" are given to the pixel circuits 10, which indicate that the circuits are light emitting pixels of respective colors of R (red), G (Green) and B (Blue).

In order to drive respective pixel circuits 10 in the pixel array unit 20, a horizontal scanner 11, a write scanner 12 and a drive scanner (drive control scanner) 13 are included.

Additionally, signal lines DTL1, DTL2 . . . which are selected by the horizontal selector 11 and supply video signals corresponding to luminance information as input signals with respect to the pixel circuits 10 are arranged in the column direction in the pixel array unit 20. The signal lines DTL1, DTL2 . . . are arranged by the number of columns of the pixel circuits 10 arranged in the matrix state in the pixel array unit 20.

Furthermore, write control lines WSL1, WSL2 . . . and power control lines DSL1, DLS2 . . . are arranged in the row direction in the pixel array unit 20. These write control lines WSL and the power control lines DSL are arranged by the number of rows of the pixel circuits 10 arranged in the matrix state in the pixel array unit 20.

The write control lines WSL (WSL1, WSL2 . . . ) are driven by the write scanner 12. The write scanner 12 supplies scanning pulses WS (WS1, WS2 . . . ) sequentially to respective write control lines WSL1, WSL2 arranged in rows at set predetermined timings to perform line-sequential scanning of the pixel circuits 10 by the row.

The power control lines DSL (DSL1, DLS2 . . . ) are driven by the drive scanner 13. The drive scanner 13 supplies power pulses DS (DS1, DS2 . . . ) as a power supply voltages switched to three values of a drive voltage (V1), an intermediate voltage (V2) and an initial voltage (Vini) to respective power control lines DSL1, DSL2 . . . arranged in rows so as to correspond to the line-sequential scanning by the write scanner 12.

The horizontal selector 11 supplies a signal potential (Vsig) and a reference potential (Vofs) as input signals with respect to the pixel circuits 10 to the signal lines DTL1, DTL2 . . . arranged in the column direction so as to correspond to the line-sequential scanning by the write scanner 12.

Figure 2:
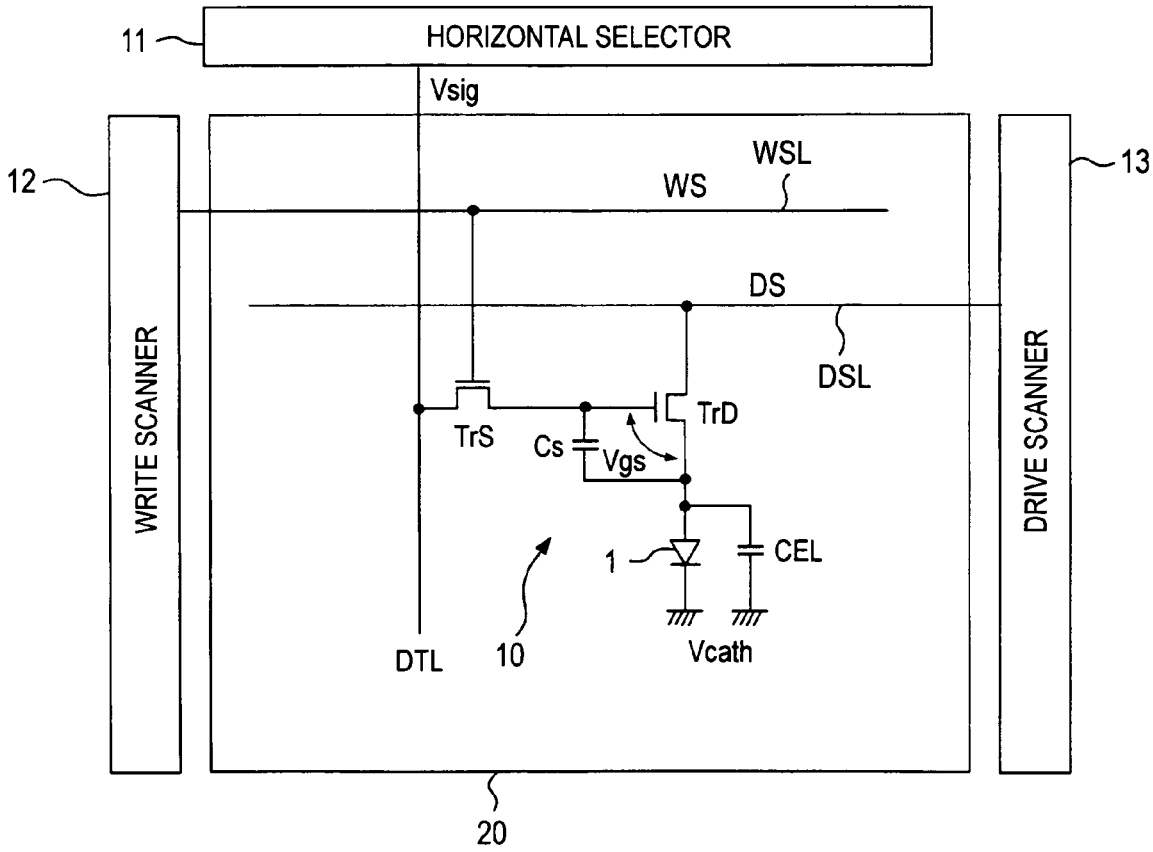
FIG. 2 is an explanatory diagram of a pixel circuit configuration according to the embodiment.

FIG. 2 shows a configuration of the pixel circuit 10. The pixel circuits 10 are arranged in a matrix state as shown in the pixel circuits 10 in the configuration of FIG. 1. In FIG. 2, only one pixel circuit 10 is shown for simplification, which is arranged at a portion where the signal line DTL, the write control line WSL and the power control line DSL cross one another.

The pixel circuit 10 includes an organic EL element 1 as a light emitting element, a storage capacitor Cs and two thin-film transistors (TFT) as a sampling transistor TrS and a drive transistor TrD. The sampling transistor Trs and the drive transistor TrD are n-channel TFTs.

One terminal of the storage capacitor Cs is connected to a source of the drive transistor TrD, and the other terminal is connected to a gate of also the drive transistor TrD.

The light emitting element of the pixel circuit 10 is, for example, an organic EL element 1 of a diode configuration, having an anode and a cathode. The anode of the organic EL element 1 is connected to the source S of the drive transistor TrD and the cathod is connected to a given ground wiring (cathode potential Vcath). A capacitor CEL is a parasitic capacitor of the organic EL element 1.

One terminal of drain/source of the sampling transistor TrS is connected to the signal line DTL and the other terminal is connected to the gate of the drive transistor TrD. A gate of the sampling transistor TrS is connected to the write control line WSL.

A drain of the drive transistor TrD is connected to the power control line DSL.

Light emitting drive of the organic EL element 1 is performed in the following manner.

The sampling transistor TrS becomes conductive by the scanning pulse WS given from the write scanner 12 by the write control line WSL at the timing when the signal potential Vsig is applied to the signal line DTL. Accordingly, the input signal Vsig from the signal line DTL is written in the storage capacitor Cs. The drive transistor TrD allows current corresponding to the signal potential stored in the storage capacitor Cs in the organic EL element 1 by current supply from the power control line DSL to which the drive potential V1 is given by the drive scanner 13 to thereby allow the, organic EL element 1 to emit light.

In the pixel circuit 10, an operation (hereinafter, referred to as a Vth cancel operation) for correcting effects of variation of a threshold voltage Vth of the drive transistor TrD before current drive of the organic EL element 1 is performed. Further, a mobility correction operation for cancelling effects of variation of mobility of the drive transistor TrD is performed simultaneously with the writing the input signal Vsig from the signal line DTL to the storage capacitor Cs.

2. Pixel Circuit Operation in a Process Leading to an Embodiment of the Invention Here, a circuit operation studied in the process leading to the invention in the above pixel circuit 10 will be explained. Particularly, an operation of performing divided correction as the Vth cancel will be explained with reference to FIG. 3.

Figure 3:
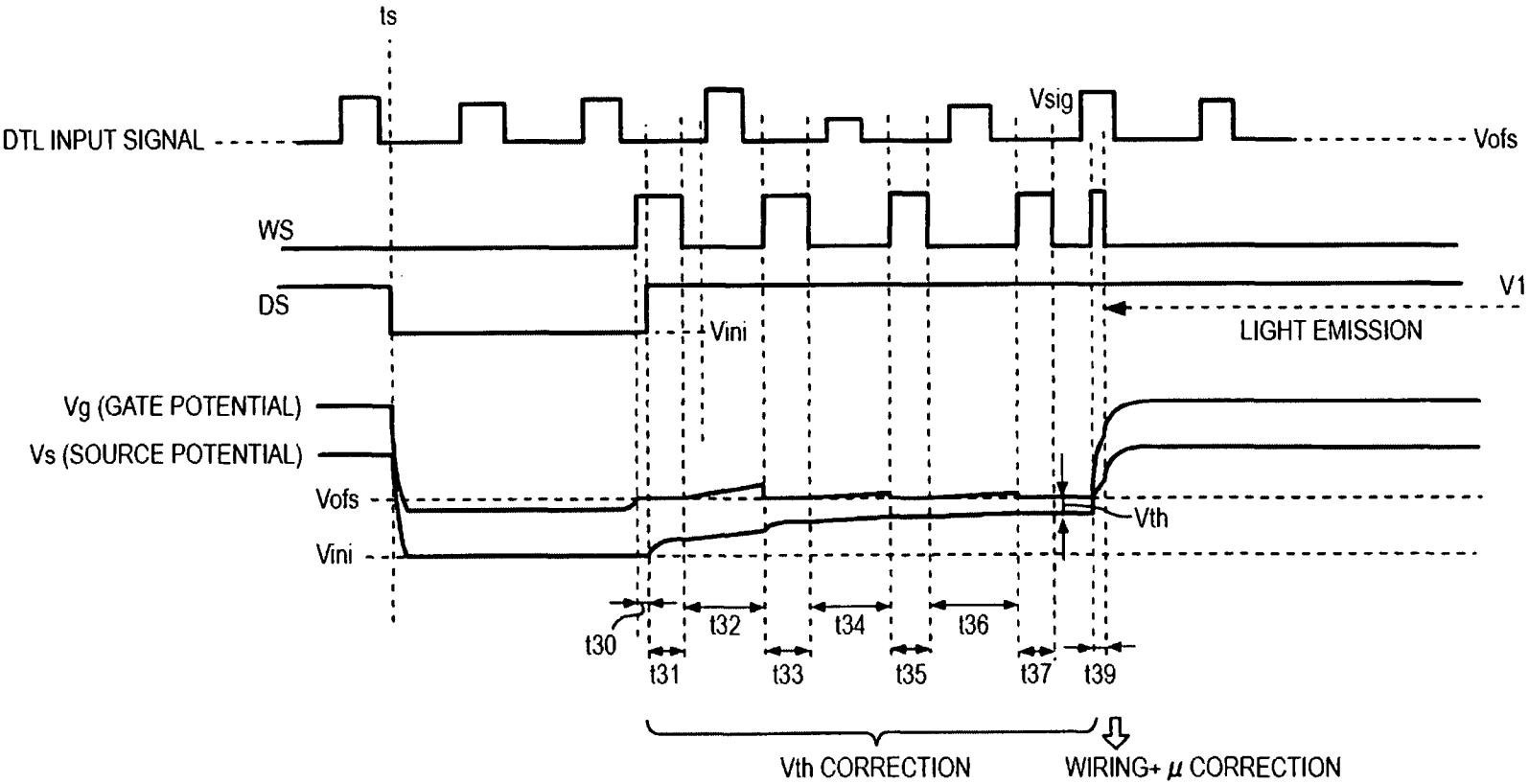
FIG. 3 is an explanatory chart of a pixel circuit operation before reaching the embodiment.

In FIG. 3, the potentials (the signal potential Vsig and the reference potential Vofs) given to the signal line DTL by the horizontal selector 11 are shown as the DTL input signal.

As the scanning pulse WS, a pulse to be applied to the write control line WSL by the write scanner 12 is shown. The sampling transistor TrS is controlled to be conductive/non-conductive by the scanning pulse WS.

As the power pulse DS, voltages to be applied to the power control line DSL by the drive scanner 13 are shown. As the voltages, the drive scanner 13 supplies the drive voltage V1 and the initial voltage Vini to be switched at predetermined timings.

The variations of a gate potential Vg, a source potential Vs of the drive transistor TrD are also shown.

A point "ts" in a timing chart of FIG. 3 indicates a start timing of one cycle in which the organic EL element 1 as the light emitting element is driven for emitting light, for example, one frame period of image display.

First, the drive scanner 13 supplies the initial potential Vini as the power pulse DS at the point "ts". Accordingly, the source potential Vs of the drive transistor TrD is reduced at the initial potential Vini and the organic EL element 1 is in a non-light emitting state. The gate potential Vg of the drive transistor TrD in a floating state is also reduced.

After that, a preparation for the Vth cancel operation is made during a period "t30". That is, when the signal line DTL is in the reference potential Vofs, the scanning pulse WS is made to be H-level to allow the sampling transistor TrS to be conductive. Accordingly, the gate potential Vg of the drive transistor TrD is fixed at the potential Vofs. The source potential Vini maintains the initial potential Vini.

According to the above, a voltage Vgs between the gate and the source of the drive transistor TrD is made to be higher than the threshold voltage Vth to thereby preparing the Vth cancel operation.

Next, the Vth cancel operation is started. In this case, the threshold correction is performed in a time division manner in periods t31, t33, t35 and t37.

First, in the period "t31", the power pulse DS is made to be in the drive potential V1 by the drive scanner 13 while the gate potential Vg of the drive transistor TrD is fixed in the reference potential Vofs, thereby increasing the source potential Vs.

At this time, the write scanner 12 turns on the scanning pulse WS intermittently in periods when the signal line DTL is in the reference voltage Vofs for preventing the source potential Vs from exceeding the threshold of the organic EL element 1 as well as for allowing the sampling transistor TrS to be non-conductive in periods when the DTL input signal is in the signal potential Vsig. Accordingly, the Vth cancel operation is performed in periods t31, t33, 335 and t37 in the divided manner.

The Vth cancel operation is completed when the voltage Vgs between the gate and the source of the drive transistor TrD is equal to the threshold voltage Vth (period t37).

In a period t32 (after-correction period) after the period t31 when the Vth correction operation is performed, an after-correction period t34 after the period t33 as well as an after-correction period t36 after the period t35, the sampling transistor TrS is in an off state by the scanning pulse WS. This is for preventing signal values from being applied to the gate of the drive transistor TrD during period in which the DTL input signal is in signal value voltages (signal values for pixels of other lines). However, in the after-correction periods t32, t34 and t36, the drive potential V1 from the power control line DSL is continuously supplied to the drain of the drive transistor TrD.

Since the drive transistor TrD is not completely cut off, electric current is not completely stopped, consequently, a phenomenon in which the source potential Vs is increased and the gate potential Vg is increased accordingly as shown in the drawing. The increased gate potential Vg is returned to the reference potential Vofs as the DTL input signal when the sampling transistor TrS is turned on by the scanning pulse WS.

As described above, after the Vth cancel operation is performed in the divided manner of plural times, the scanning pulse WS is turned on at a timing (period t39) when the signal line DTL becomes in the signal potential Vsig with respect to the pixel circuit, thereby writing the signal potential Vsig in the storage capacitor Cs. The period t39 is also a mobility correction period of the drive transistor TrD.

In the period t39, the source potential Vs is increased in accordance with the mobility of the drive transistor TrD. That is, when the mobility of the transistor TrD is high, the increased amount of the source potential Vs is high, and when the mobility is low, the increased amount of the source potential Vs is low. As a result, this will be the operation of adjusting the voltage Vgs between the gate and the source of the drive transistor TrD in the light emitting period in accordance with the mobility.

After that, when the source potential Vs is in the potential exceeding the threshold of the organic EL element 1, the organic EL element 1 emits light.

In short, the drive transistor TrD allows drive current to flow in accordance with the potential stored in the storage capacitor Cs to thereby emit light in the organic EL element 1. At this time, the source potential Vs of the drive transistor TrD is held in a given operation point.

The drive potential V1 is applied to the drain of the drive transistor TrD from the power control line DSL so that the drive transistor TrD is constantly operated in a saturated region, therefore, the drive transistor TrD functions as a constant current source and an electric current Ids flowing in the organic El element 1 will be represented by the following formula 1 in accordance with the voltage Vgs between the gate and the source of the drive transistor TrD.

$$I_{ds} = \frac{1}{2}\mu\frac{W}{L}C_{ox}(V_{gs} - V_{th})^2 \quad \text{[Formula 1]}$$

Ids represents the electric current flowing between the drain and the source of the transistor operating in the saturation region, i represents the mobility, W represents a channel width, L represents a channel length, Cox represents a gate capacity, Vth represents a threshold voltage of the drive transistor TrD and Vgs represents the voltage between the gate and the source of the drive transistor TrD.

Figure 4:
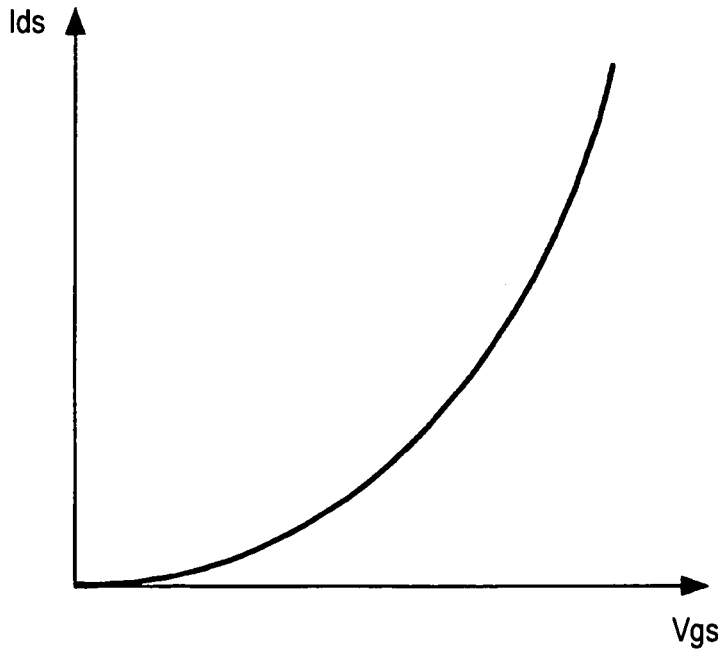
FIG. 4 is an explanatory graph of Ids-Vgs characteristics of a drive transistor.

As can be seen from the Formula 1, the electric current Ids depends on a square value of the voltage Vgs between the gate and the source of the drive transistor TrD, therefore, the relation between the electric current Ids and the voltage Vgs between the gate and the source will be as shown in FIG. 4.

The drain current Ids of the drive transistor TrD is controlled by the voltage Vgs between the gate and the source in the saturation region. Since the voltage Vgs between the gate and the source of the drive transistor TrD (=Vsig+Vth) is fixed by the action of the storage capacitor Cs, therefore, the drive transistor TrD is operated as the constant current source allowing the fixed current to flow in the organic EL element 1.

Accordingly, an anode potential (source potential Vs) of the organic EL element 1 is increased to a voltage at which electric current flows in the organic EL element 1 to allow the organic EL element to emit light. That is, light emission at luminance in accordance with the signal voltage Vsig in this frame is started.

Accordingly, in the pixel circuit 10, the operation for light emission of the organic EL element 1 including the Vth cancel operation and the mobility correction is performed in one frame period.

According to the Vth cancel operation, electric current corresponding to the signal potential Vsig can be given to the organic EL element 1 regardless of variation of the threshold voltage Vth of the drive transistor TrD in each pixel circuit 10 or change of the threshold voltage Vth due to change over time. That is, it is possible to maintain high image quality without generating luminance variation and the like on the screen by cancelling the variation of the threshold voltage Vth on manufacture or by the change over time.

Since the drain current changes also by the mobility of the drive transistor TrD, image quality is reduced by variation of the mobility of the drive transistor TrD at each pixel circuit 10, the source potential Vs can be obtained according to the degree of mobility of the drive transistor TrD by the mobility correction, as a result, the source potential Vs is adjusted to obtain the voltage Vgs between the gate and the source which absorbs variation of the mobility of the drive transistor TrD in each pixel circuit 10, therefore, reduction of image quality due to the variation of mobility is also prevented.

3. Pixel Circuit Operation as a First Embodiment of the Invention

As described above, as a pixel circuit operation of one cycle, the Vth cancel operation is performed in the divided manner plural times. The reason that the Vth cancel operation is performed plural times in the time division manner is because there is a request for the high frequency in the display device.

As the frame rate becomes higher, operation time of the pixel circuit becomes relatively shorter, therefore, it is difficult to secure the continuous Vth cancel period. Accordingly, the period necessary for the Vth cancel is secured by performing the Vth cancel operation in the time division manner to thereby allow the voltage between the gate and the source of the drive transistor TrD to be converged to the threshold voltage Vth.

However, when the Vth cancel operation in the time division manner as FIG. 3 is performed, the source potential Vs and the gate potential Vg are increased at the after-correction periods t32, t34 and t36 as described above. This raises fears of malfunctions in the Vth cancel operation.

After the source potential Vs and the gate potential Vg are increased in the after-correction periods t32, t34 and t36 as described above, the gate potential Vg is returned to the reference potential Vofs by re-starting the Vth cancel operation, however, the source potential Vs maintains increased potential. At this time, the voltage between the gate and the source may possibly be decreased to be lower than the threshold voltage Vth in some cases. In such case, the accurate Vth cancel operation is not realized.

Accordingly, in order to address the circumstances, it becomes preferable that the drive transistor TrD is forcibly cut off in the after-correction periods t32, t34 and t36.

On the other hand, it is also requested that the Vth cancel operation is performed rapidly.

For example, in the example of FIG. 3, the Vth cancel operation is performed by dividing the operation period into periods t31, t33, t35 and t37.

When the drive transistor TrD is forcibly cut off in after-correction periods, the increase of the source potential Vs and the gate potential Vg can be prevented.

However, since the drive transistor TrD is cut off by some method for the above purpose, it is necessary to devise some methods for the DTL input signal, the scanning pulse WS and the power pulse DS in the after-correction periods.

The performance of the above operations complicates the circuit operation control. That is, the change of the pulse level in the write control line WSL and the power control line DSL is increased in one cycle. It is necessary to reduce the number of divided Vth cancel operations for reducing the change.

Then, it is requested to speed up the Vth cancel operation and to shorten the whole period of time necessary as the cancel operation for reducing the number of divided Vth cancel operations.

Accordingly, as the pixel circuit operation according to the embodiment, a method realizing both accuracy and quickness in the Vth cancel operation will be explained below.

Figure 5:
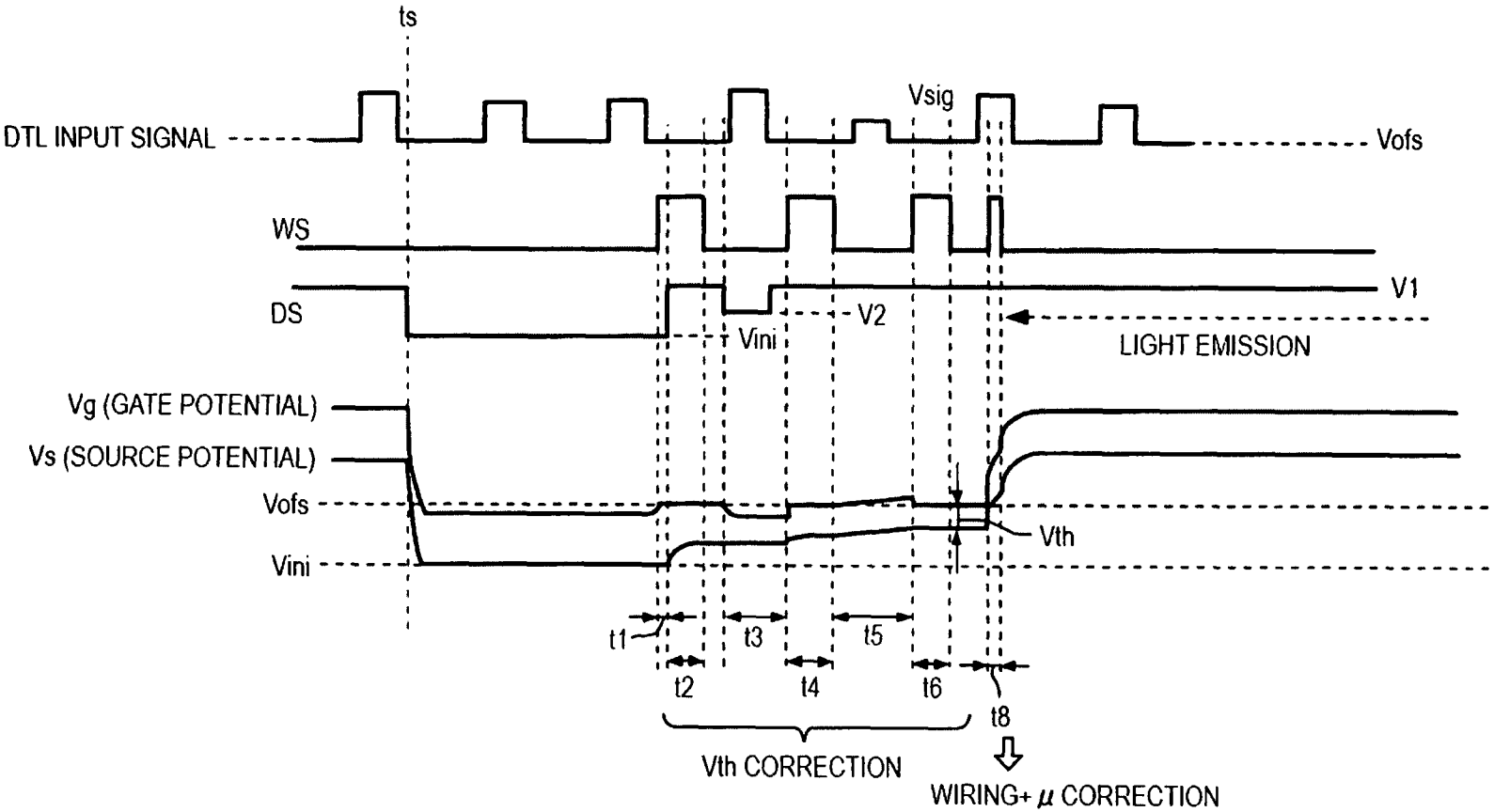
FIG. 5 is an explanatory chart of a pixel circuit operation according to a first embodiment.

FIG. 5 shows a circuit operation according to the embodiment.

Also in FIG. 5, potentials (the signal potential Vsig and the reference potential Vofs) given to the signal line DTL by the horizontal selector 11 are shown as the DTL input signal in the same manner as FIG. 3.

As the scanning pulse WS, a pulse to be applied to the write control line WSL by the write scanner 12 is shown.

As the power pulse DS, voltages to be applied to the power control line DSL by the drive scanner 13 are shown. In the case of FIG. 5, as voltages to be applied to the power control line DSL, the intermediate voltage V2 is generated by the drive scanner 13 in addition to the drive potential V1 and the initial potential Vini, which are switched at predetermined timings.

The changes of the gate potential Vg and the source potential Vs of the drive transistor TrD are also shown.

A cycle of the light-emitting drive operation of the organic EL element 1 is started as a point "ts" at a timing chart of FIG. 5.

First, the drive scanner 13 allows the power pulse DS given to the power control line DSL to be the initial potential Vini at the point "ts". According to this, the source potential Vs of the drive transistor TrD is reduced at the initial potential Vini and the organic EL element 1 is in the non-light emitting state. The gate potential Vg of the drive transistor TrD is also reduced.

After that, a preparation for the Vth cancel operation is made during a period "t1". That is, when the signal line DTL is in the reference voltage Vofs, the scanning pulse WS is made to be H-level by the drive scanner 13 to allow the sampling transistor TrS to be conductive. Accordingly, the gate potential Vg of the drive transistor TrD is fixed to the voltage Vofs. The source potential Vs maintains the initial potential Vini. As the preparation for the Vth cancel, the voltage Vgs between the gate and the source of the drive transistor TrD is made to be higher than the threshold voltage Vth in this manner.

Next, the Vth cancel operation is started. In this case, the threshold correction is performed in the time division manner in periods t2, t4 and t6.

First, in the period t2, the power pulse DS is made to be the drive potential V1 by the drive scanner 13 while fixing the gate voltage Vg of the drive transistor TrD to be the reference potential Vofs, thereby increasing the source potential Vs.

The Vth cancel operation is executed in the periods t4, t6 in the same manner.

The Vth cancel operation is completed when the voltage Vgs between the gate and the source of the drive transistor TrD is equal to the threshold voltage Vth (period t6).

As described above, after the Vth cancel operation is performed in the divided manner of plural times, the scanning pulse WS is turned on at a timing (period t8) when the signal line DTL becomes in the signal potential Vsig with respect to the pixel circuit, thereby writing the signal potential Vsig in the storage capacitor Cs. The period t8 is also a mobility correction period of the drive transistor TrD.

In the period t8, the source potential Vs is increased in accordance with the mobility of the drive transistor TrD. That is, when the mobility of the transistor TrD is high, the increased amount of the source potential Vs is high, and when the mobility is low, the increased amount of the source potential Vs is low. As a result, this will be the operation of adjusting the voltage Vgs between the gate and the source of the drive transistor TrD in the light emitting period in accordance with the mobility.

After that, when the source potential Vs is in the potential exceeding the threshold of the organic EL element 1, the organic EL element 1 emits light.

In short, the drive transistor TrD allows drive current to flow in accordance with the potential stored in the storage capacitor Cs to thereby emit light in the organic EL element 1. At this time, the source potential Vs of the drive transistor TrD is held in a given operation point.

The drive potential V1 is applied to the drain of the drive transistor TrD from the power control line DSL so that the drive transistor TrD is constantly operated in a saturated region, therefore, the drive transistor TrD functions as a constant current source, and the electric current Ids represented by the above Formula 1, namely, the electric current corresponding to the voltage Vgs between the gate and the source of the drive transistor TrD flows in the organic EL element 1. According to this, the organic EL element 1 emits light at luminance corresponding to the signal value Vsig.

In the above operation of the embodiment, the Vth cancel operation is performed in the time division manner in periods t2, t4 and t6. In the after-correction period t3 as the first time, the drive transistor TrD is completely cut off to thereby prevent the increase of the source potential Vs and the gate potential Vg. On the other hand, the drive transistor TrD is not forcibly cut off in the second after-correction period t5 so as not to stop the electric current Ids completely, thereby increasing the source potential Vs and the gate potential Vg.

First, in the first after-correction period t3, the drive transistor is cut off by making the power pulse DS from the power control line DSL be the intermediate potential V2.

Figure 6:
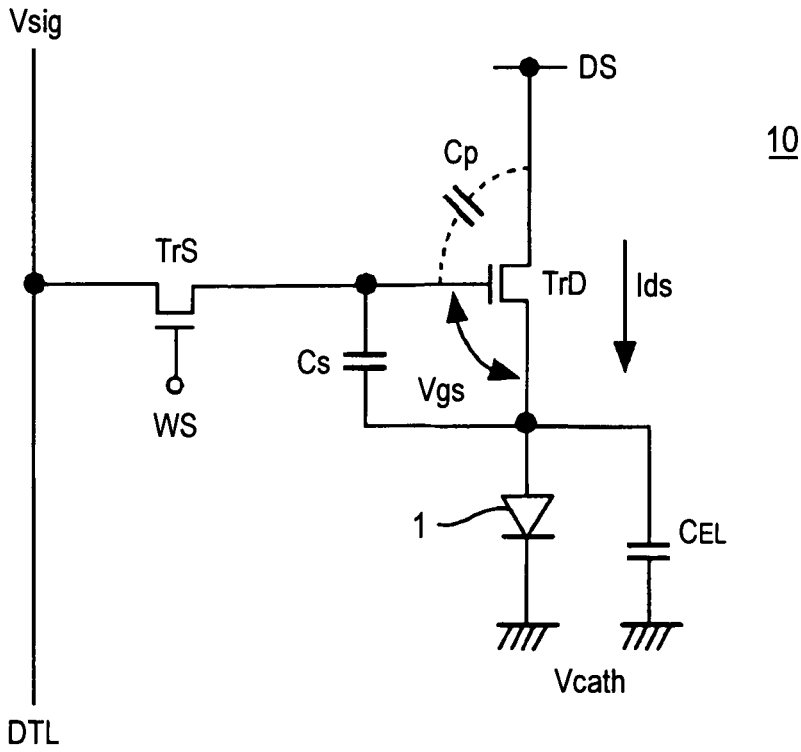
FIG. 6 is an explanatory diagram of a cut-off control operation according to the first embodiment.

The power pulse DS is made to be the intermediate potential V2 to thereby form a coupling through a parasitic capacitor Cp between the gate and drain of the drive transistor TrD shown in FIG. 6.

Accordingly, the voltage between the gate and the source of the drive transistor TrD is reduced and cut off the drive transistor TrD to be in the state in which the electric current Ids does not flow.

As described above, the drive transistor TrD is cut off in the after-correction periods t3 to prevent the increase of the source potential Vs and the gate potential Vg as shown in FIG. 5.

In this case, in order to normally perform the cut-off control operation, the power pulse DS is reduced to the intermediate potential V2 after the scanning pulse WS is made to be L-level to turn off the sampling transistor TrS as shown in a start timing and an end timing of the after-correction period t3. Before the scanning pulse WS rises again, the power pulse DS is made to be the drive potential V1.

It is necessary that the intermediate potential V2 is higher than a value (Vofs-Vth) in which the drive transistor TrD is not turned on. When the intermediate potential V2 is less than the value (Vofs-Vth), the gate potential Vg is reduced when the Vth cancel operation in the time division manner is performed and there is a case in which the threshold voltage Vth is not held when the scanning pulse WS rises again.

Additionally, in order to increase a negative coupling value, it is desirable to apply a value as large as possible as the maximum power-pulse voltage value within the withstand voltage.

On the other hand, in the second after-correction period t5, the drive transistor TrD is not forcibly cut off. That is, as shown in FIG. 5, the power pulse DS from the power control line DSL is held in the drive potential V1 in the after-correction period t5.

The source potential Vs and the gate potential Vg increase in the after-correction period t5 as shown in the drawing because the drive transistor TrD is not cut off in this case.

Here, when the scanning pulse WS rises in the next period t6 and the third Vth cancel operation is started, the reference potential Vofs as the DTL input signal is applied to the gate of the drive transistor Trd. That is, the gate potential Vg increased in the after-correction period t5 is returned to the reference potential Vofs. However, the source potential Vs holds the increased potential. As a result, the voltage Vgs between the gate and the source of the drive transistor TrD becomes narrower than the voltage at the end of the previous period t4, which is close to the threshold voltage Vth. That is, the increase of the source potential Vs in the after-correction period t5 accelerates the voltage Vgs between the gate and the source to attain the threshold voltage Vth. In other words, the increase amount of the source potential Vs is appropriated to the voltage for Vth cancel.

In the case of FIG. 5, the voltage between the gate and the source is equal to Vth in the period t6 and the Vth cancel operation is completed.

As described above, in the case of the embodiment, the drive transistor TrD is cut off in the first after-correction period t3 and the drive transistor TrD is not cut off in the second after-correction period t5, thereby realizing the accuracy of the threshold correction and the shortening of the correction period.

First, in the first after-correction period t3, the voltage Vgs between the gate and the source is relatively high, therefore, if the cut-off is not performed, relatively high electric current flows and the source potential Vs and the gate potential Vg largely increase. (For example, as can be seen from the example of FIG. 3, the degree of potential increase is considerably large in the first after-correction period t32 as compared with the second and third after-correction periods t34, t36).

Then, the voltage Vgs between the gate and the source may possibly be decreased to be lower than the threshold voltage Vth in some cases when the gate potential Vg is equal to the reference potential Vofs in the period t4 in which the next Vth cancel operation is performed. In this case, it is difficult to realize the accurate threshold correction operation. Accordingly, the drive transistor TrD is cut off in the first after-correction period t3 so as not to allow the source potential Vs and the gate potential Vg to be increased, thereby securing the accuracy of the threshold correction operation.

On the other hand, in the second after-correction period t5 after the Vth cancel operation is performed twice in the periods t2, t4, the voltage Vgs between the gate and the source have already been narrowed to some degree, therefore, the amount of electric current is small and sudden increase of the source potential Vs and the gate potential Vg does not occur. Accordingly, the voltage Vgs between the gate and the source does not become lower than the threshold voltage Vth even when the gate potential Vg is returned to the reference potential Vofs in the next period t6.

Accordingly, the drive transistor TrD is not cut off in the after-correction period t5, and the voltage Vgs between the gate and the source is narrowed at the start point of the next Vth cancel operation (period t6), thereby accelerating the Vth cancel operation by using the increase amount of the source potential Vs due to the cut-off.

It is possible to realize the accuracy of the threshold correction and the shortening of the whole correction period of the threshold voltage by the above operation. Due to the shortening of time by accelerating the threshold correction operation, the threshold correction can be performed by divided correction operations of three times in the periods t2, t4 and t6, for example, as shown in FIG. 5, as a result, the number of divided corrections can be reduced as compared with the divided correction operation of four times shown in FIG. 3.

The reduction of the number of divided corrections, further, the cut-off is not performed in plural after-correction periods, thereby reducing voltage change of the power pulse DS.

As described above, if the drive transistor TrD is cut off every time in plural after-correction periods in order to realize the accuracy of the threshold correction operation, the power pulse DS is made to be the intermediate potential V2 every time in plural after-correction periods, when following the cut-off control method of FIG. 5. This causes frequent change of the pulse level in the power control line WSL within one cycle, therefore, so-called power fluctuation tends to occur, which narrows an operation margin of each power supply. However, the power pulse DS is made to be the intermediate voltage V2 only in the first after-correction period t3 in the embodiment, therefore, it is not necessary to change the pulse level frequently in the power control line WSL. According to this, the operation margin of the power supply is not considerably narrowed and there is no disadvantage on design.

4. Pixel Circuit Operation as a Second Embodiment of the Invention

The pixel circuit operation according to a second embodiment will be explained with reference to FIG. 7.

Figure 7:
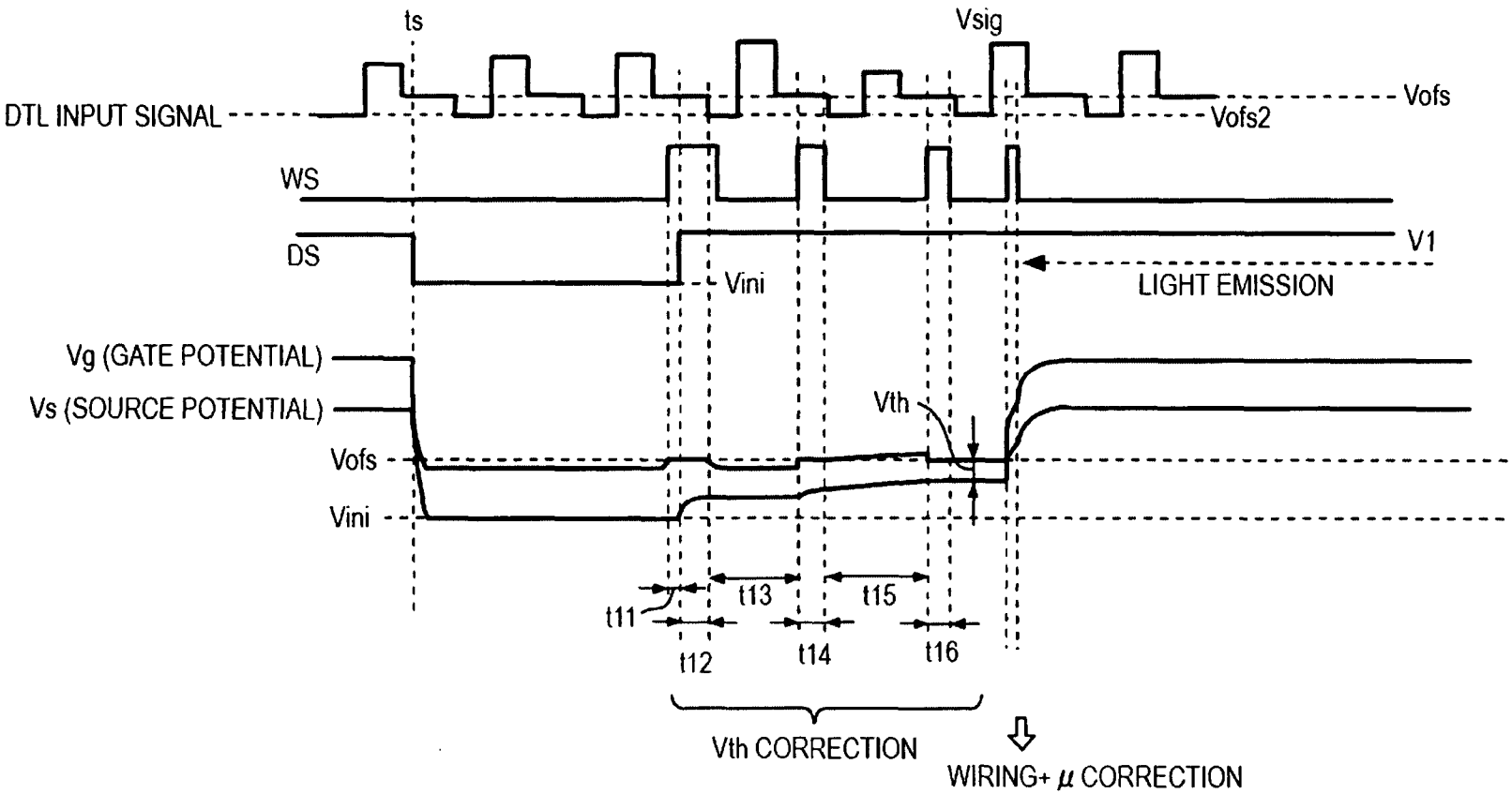
FIG. 7 is an explanatory chart of a pixel circuit operation according to a second embodiment.

FIG. 7 shows respective waveforms in the same manner as FIG. 5.

After the preparation for the Vth cancel operation is made in a period t11, the Vth cancel operation is performed in the time division manner in periods t12, t14 and t16.

Then, in this case, the drive transistor TrD is completely cut off in a first after-correction period t13, thereby preventing the increase of the source potential Vs and the gate potential Vg as shown in the drawing.

On the other hand, the drive transistor TrD is not forcibly cut off in a second after-correction period t15, as a result, the source potential Vs and the gate potential Vg increase. Then, the gate potential Vg is made to be the reference potential Vofs at the time of the Vth cancel operation in the period t16, thereby accelerating the Vth cancel operation in the same manner as the first embodiment described above.

In the case of the embodiment of FIG. 7, in order to cut off the drive transistor TrD, a low potential Vofs2 for the cut-off is supplied as the DTL input signal generated by the horizontal selector 11, in addition to the signal value (Vsig) and the reference potential Vofs.

For example, a start point of the first after-correction period t13 just after the period t12 is a timing when the DTL input signal is made to be the low potential Vofs2. Since the sampling transistor TrS maintains an on state by the scanning pulse WS at that point, the low potential Vofs2 is given to the gate of the drive transistor TrD.

At a start point of the second after-correction period 15 just after the period t14, the sampling transistor TrS is turned off by the scanning pulse WS before the DTL input signal is made to be in the low potential Vofs2, thereby preventing the forcible cut-off control.

According to the case of the second embodiment described above, the same advantages as the first embodiment can be obtained.

The embodiments of the invention have been explained as the above, however, the invention is not limited to the embodiments and various modifications can be considered.

For example, the configuration example including two transistors TrD, TrS and the storage capacitor Cs as shown in FIG. 2 is cited as the pixel circuit 10 of the embodiment, however, the invention can be applied to pixel circuits other than the above, for example, a case of the pixel circuit having a configuration including three or more transistors.

In the above first and second embodiments, the drive transistor TrD is cut off in the first after-correction period and the drive transistor TrD is not cut off in the second after-correction period.

For example, in the case that there are three after-correction periods, an operation example in which the cut-off is performed in the first and second periods and the cut-off is not performed in the third period, or an operation example in which the cut-off is performed in the first and third periods and the cut-off is not performed in the second period can be considered.

As a matter of course, when there are four or more after-correction periods, various operation examples can be considered.

Particularly, the concept in which the cut-off is performed at least in the first after-correction period is suitable in a point that malfunction in the Vth cancel operation is avoided by performing the cut-off in the first period when the amount of leak current is high. Also, the concept in which plural after-correction periods are divided into a first half and a last half, the cut-off is performed in after-correction periods of the first half and the cut-off is not performed in after-correction periods of the last half is suitable from the same meaning. However, according to operations by the actual circuit design, characteristics of the drive transistor TrD and the like, various states can be considered as states of respective after-correction periods. Therefore, it is preferable to determine in which after-correction period the cut-off is performed and in which after-correction period the cut-off is not performed in plural after-correction periods according to the actual design circuit and operations of respective scanners.

The present application contains subject matter related to that disclosed in Japanese Priority Patent Application JP 2008-210508 filed in the Japan Patent Office on Aug. 19, 2008, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array including pixel circuits arranged in a matrix state, in which each pixel circuit has at least:

a light emitting element, a drive transistor that has a first current electrode connected to a current path connected to the light emitting element and is configured to supply electric current to the light emitting element, the magnitude of the electric current supplied to the light emitting element depending on a gate-source voltage between a gate electrode of the drive transistor and the first current electrode of the drive transistor, and a storage capacitor connected between the gate electrode of the drive transistor and the first current electrode of the drive transistor and that is configured to store a threshold voltage of the drive transistor and an inputted signal value; and a driving circuit configured to:

selectively apply a signal potential and a reference potential to the gate electrode of the drive transistor of each pixel circuit and to the storage capacitor of each pixel circuit, selectively apply a drive voltage to a second current electrode of the drive transistor of each pixel circuit, and perform a threshold correction operation for a given one of the pixel circuits during a plurality of threshold correction periods, wherein the plurality of threshold correction periods occur during a frame period before the signal potential is applied to the storage capacitor of the given one of the pixel circuits, and wherein the threshold correction operation causes the storage capacitor of the given one of the pixel circuits to store the threshold voltage of the drive transistor of the given one of the pixel circuits and comprises applying the drive voltage to the drive transistor of the given one of the pixel circuits while the reference potential is applied to the gate electrode of the drive transistor of the given one of the pixel circuits;

wherein there are a plurality of after-correction periods during the frame period, each of the plurality of after-correction periods beginning after one of the plurality of threshold correction periods ends and before a next one of the plurality of threshold correction periods starts, and wherein the driving circuit is further configured to:

place the drive transistor of the given one of the pixel circuits in a cut-off state during at least one of the plurality of after-correction periods prior to the threshold voltage of the drive transistor of the given one of the pixel circuits being stored in the storage capacitor of the given one of the pixel circuits, the cut-off state corresponding to a state in which a current does not flow through the drive transistor of the given one of the pixel circuits, and not place the drive transistor of the given one of the pixel circuits in the cut-off state during at least one of the plurality of after-correction periods.

2. The display device according to claim 1, wherein the driving circuit places the drive transistor of the given one of the pixel circuits in the cut-off state by supplying an intermediate voltage, which is lower than the drive voltage, to the drive transistor of the given one of the pixel circuits, and wherein the driving circuit applies the drive voltage to the drive transistor of the given one of the pixel circuits in the at least one of the plurality of after-correction periods in which the drive transistor of the given one of the pixel circuits is not placed in the cut-off state.

3. The display device according to claim 2, wherein the driving circuit comprises:

a signal selector configured to selectively supply the signal potential and the reference potential to signal lines, each of the pixel circuits corresponding to one of the signal lines;

a write scanner connected to write control lines, each of the pixel circuits corresponding to one of the write control lines, wherein the write scanner is configured to control the introduction of the signal potential and the reference potential carried on the signal lines into the given one of the pixel circuits by driving the one of the write control lines that corresponds to the given one of the pixel circuits; and a drive control scanner connected to power control lines, each of the pixel circuits corresponding to one of the power control lines, wherein the drive control scanner is configured to selectively apply the drive voltage to the drive transistor of the given one of the pixel circuits through the one of the power control lines corresponding to the given one of the pixel circuits.

4. The display device according to claim 3, wherein the driving circuit is configured to place the drive transistor in the cut-off state in at least a first after-correction period of the plurality of after-correction periods.

5. The display device according to claim 3, wherein the driving circuit is configured to place the drive transistor of the given one of the pixel circuits in the cut-off state in those of the plurality of after-correction periods that correspond to a first half of the plurality of after-correction periods and to not place the drive transistor of the given one of the pixel circuits in the cut-off state in those of the plurality of after-correction periods that correspond to a last half of the plurality of after-correction periods.

6. The display device according to claim 3, wherein each of the pixel circuits further includes a sampling transistor, wherein a gate electrode of the sampling transistor of the given one of the pixel circuits is connected to the one of the write control lines that corresponds to the given one of the pixel circuits, a first current electrode of the sampling transistor of the given one of the pixel circuits is connected to the one of the signal lines that corresponds to the given one of the pixel circuits, and a second current electrode of the sampling transistor of the given one of the pixel circuits is connected to the gate electrode of the drive transistor of the given one of the pixel circuits, and wherein the first current electrode of the drive transistor of the given one of the pixel circuits is connected to the light emitting element of the given one of the pixel circuits and the second current electrode of the drive transistor of the given one of the pixel circuits is connected to the one of the power control lines corresponding to the given one of the pixel circuits.

7. The display device according to claim 1, wherein the driving circuit places the drive transistor of the given one of the pixel circuits in the cut-off state by applying a cut-off control potential to the gate electrode of the drive transistor of the given one of the pixel circuits, and wherein the driving circuit does not apply the cut-off control potential to the gate electrode of the drive transistor of the given one of the pixel circuits in the at least one of the plurality of after-correction periods in which the drive transistor of the given one of the pixel circuits is not placed in the cut-off state.

8. The display device according to claim 7, wherein the driving circuit comprises:

a signal selector configured to selectively supply the signal potential, the reference potential, and the cut-off control potential to signal lines, each of the pixel circuits corresponding to one of the signal lines;

a write scanner connected to write control lines, each of the pixel circuits corresponding to one of the write control lines, wherein the write scanner is configured to control the introduction into the given one of the pixel circuits of the signal potential, the reference potential, and the cut-off control potential carried on the signal lines by driving the one of the write control lines that corresponds to the given one of the pixel circuits; and a drive control scanner connected to power control lines, each of the pixel circuits corresponding to one of the power control lines, wherein the drive control scanner is configured to selectively apply the drive voltage to the drive transistor of the given one of the pixel circuits through the one of the power control lines that corresponds to the given one of the pixel circuits.

9. A display drive method of a display device, wherein the display device includes:

a pixel array having pixel circuits arranged in a matrix state, in which each pixel circuit has at least:

a light emitting element, a drive transistor that has a first current electrode connected to a current path connected to the light emitting element and is configured to supply electric current to the light emitting element, the magnitude of the electric current supplied to the light emitting element depending on a gate-source voltage between a gate electrode of the drive transistor and the first current electrode of the drive transistor, and a storage capacitor connected between the gate electrode of the drive transistor and the first current electrode of the drive transistor and that is configured to store a threshold voltage of the drive transistor and an inputted signal value; and a driving circuit configured to:

selectively apply a signal potential and a reference potential to the gate electrode of the drive transistor of each pixel circuit and to the storage capacitor of each pixel circuit, selectively apply a drive voltage to a second current electrode of the drive transistor of each pixel circuit;

the method comprising the steps of:

performing a threshold correction operation for a given one of the pixel circuits during a plurality of threshold correction periods, wherein the plurality of threshold correction periods occur during a frame period before the signal potential is applied to the storage capacitor of the given one of the pixel circuits, and wherein the threshold correction operation causes the storage capacitor of the given one of the pixel circuits to store the threshold voltage of the drive transistor of the given one of the pixel circuits and comprises applying the drive voltage to the drive transistor of the given one of the pixel circuits while the reference potential is applied to the gate electrode of the drive transistor of the given one of the pixel circuits, placing the drive transistor of the given one of the pixel circuits in the cut-off state during at least one of the plurality of after-correction periods prior to the threshold voltage of the drive transistor of the given one of the pixel circuits being stored in the storage capacitor of the given one of the pixel circuits, the cut-off state corresponding to a state in which a current does not flow through the drive transistor of the given one of the pixel circuits, and not placing the drive transistor of the given one of the pixel circuits in the cut-off state during at least one of the plurality of after-correction periods, wherein the plurality of after-correction periods occur during the frame period and each of the plurality of after-correction periods begins after one of the plurality of threshold correction periods ends and before a next one of the plurality of threshold correction periods starts.

10. The display drive method according to claim 9, wherein the drive transistor of the given one of the pixel circuits is placed in the cut-off state by causing the driving circuit to supply an intermediate voltage, which is lower than the drive voltage, to the drive transistor of the given one of the pixel circuits, the method further comprising causing the driving circuit to apply the drive voltage to the drive transistor of the given one of the pixel circuits in the at least one of the plurality of after-correction periods in which the drive transistor of the given one of the pixel circuits is not placed in the cut-off state.

11. The display drive method according to claim 10, wherein the driving circuit comprises:

a signal selector configured to selectively supply the signal potential and the reference potential to signal lines, each of the pixel circuits corresponding to one of the signal lines;

a write scanner connected to write control lines, each of the pixel circuits corresponding to one of the write control lines, wherein the write scanner is configured to control the introduction of the signal potential and the reference potential carried on the signal lines into the given one of the pixel circuits by driving the one of the write control lines that corresponds to the given one of the pixel circuits; and a drive control scanner connected to power control lines, each of the pixel circuits corresponding to one of the power control lines, wherein the drive control scanner is configured to selectively apply the drive voltage to the drive transistor of the given one of the pixel circuits through the one of the power control lines corresponding to the given one of the pixel circuits.

12. The display drive method according to claim 11, wherein the method further comprises causing the driving circuit to place the drive transistor in the cut-off state in at least a first after-correction period of the plurality of after-correction periods.

13. The display drive method according to claim 11, wherein the method further comprises causing the driving circuit to place the drive transistor of the given one of the pixel circuits in the cut-off state in those of the plurality of after-correction periods that correspond to a first half of the plurality of after-correction periods and to not place the drive transistor of the given one of the pixel circuits in the cut-off state in those of the plurality of after-correction periods that correspond to a last half of the plurality of after-correction periods.

14. The display drive method according to claim 11, wherein each of the pixel circuits further includes a sampling transistor, wherein a gate electrode of the sampling transistor of the given one of the pixel circuits is connected to the one of the write control lines that corresponds to the given one of the pixel circuits, a first current electrode of the sampling transistor of the given one of the pixel circuits is connected to the one of the signal lines that corresponds to the given one of the pixel circuits, and a second current electrode of the sampling transistor of the given one of the pixel circuits is connected to the gate electrode of the drive transistor of the given one of the pixel circuits, and wherein the first current electrode of the drive transistor of the given one of the pixel circuits is connected to the light emitting element of the given one of the pixel circuits and the second current electrode of the drive transistor of the given one of the pixel circuits is connected to the one of the power control lines corresponding to the given one of the pixel circuits.

15. The display drive method according to claim 9, wherein the method further comprises causing the driving circuit to place the drive transistor of the given one of the pixel circuits in the cut-off state by applying a cut-off control potential to the gate electrode of the drive transistor of the given one of the pixel circuits, and wherein the driving circuit does not apply the cut-off control potential to the gate electrode of the drive transistor of the given one of the pixel circuits in the at least one of the plurality of after-correction periods in which the drive transistor of the given one of the pixel circuits is not placed in the cut-off state.

16. The display drive method according to claim 15, wherein the driving circuit comprises:

a signal selector configured to selectively supply the signal potential, the reference potential, and the cut-off control potential to signal lines, each of the pixel circuits corresponding to one of the signal lines;

a write scanner connected to write control lines, each of the pixel circuits corresponding to one of the write control lines, wherein the write scanner is configured to control the introduction into the given one of the pixel circuits of the signal potential, the reference potential, and the cut-off control potential carried on the signal lines by driving the one of the write control lines that corresponds to the given one of the pixel circuits; and a drive control scanner connected to power control lines, each of the pixel circuits corresponding to one of the power control lines, wherein the drive control scanner is configured to selectively apply the drive voltage to the drive transistor of the given one of the pixel circuits through the one of the power control lines that corresponds to the given one of the pixel circuits.

* * * * *